US008353711B2

(12) United States Patent
Huang et al.

(10) Patent No.: US 8,353,711 B2
(45) Date of Patent: Jan. 15, 2013

(54) ELECTRICAL CONNECTOR WITH IMPROVED METALLIC SHUTTER MECHANISM

(75) Inventors: Hsin-Kai Huang, New Taipei (TW); Yu-San Hsiao, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/181,708

(22) Filed: Jul. 13, 2011

(65) Prior Publication Data

US 2012/0015536 A1 Jan. 19, 2012

(30) Foreign Application Priority Data

Jul. 13, 2010 (TW) ..... 99213292

(51) Int. Cl.
*H01R 13/44* (2006.01)

(52) U.S. Cl. ..... 439/138

(58) Field of Classification Search ..... 439/138, 439/140–140, 607.27, 607.36, 607.01, 660
See application file for complete search history.

(56) References Cited

U.S. PATENT DOCUMENTS

| | | | | |
|---|---|---|---|---|
| 6,270,379 | B1 * | 8/2001 | Huang et al. | 439/660 |
| 7,160,120 | B2 * | 1/2007 | Zhang et al. | 439/79 |
| 7,479,042 | B2 * | 1/2009 | Chen | 439/660 |
| 7,661,990 | B1 | 2/2010 | Chiang | |
| 7,766,677 | B2 * | 8/2010 | Chiang | 439/140 |
| 2009/0042450 | A1 * | 2/2009 | Zheng et al. | 439/660 |

* cited by examiner

*Primary Examiner* — Jean F Duverne
(74) *Attorney, Agent, or Firm* — Wei Te Chung; Ming Chieh Chang

(57) ABSTRACT

An electrical connector includes a metal shell, an insulative housing, a plurality of terminals retained in the insulative housing and a shutter. The metal shell defines a receiving space with a mating port. The insulative housing defines a mating portion extending forwardly and received in the receiving space. The mating portion defines two rows of passageways exposed on opposite surfaces thereof. The terminals include contact portions retained in the corresponding passageways of the mating portion. The shutter is located in the mating port of metal shell. The shutter is made of metal sheet and pivotally mounted to the shell. The shutter includes a main portion and a pair of shafts extending outwardly form two sides of one end of the main portion.

3 Claims, 5 Drawing Sheets

ELECTRICAL CONNECTOR WITH IMPROVED METALLIC SHUTTER MECHANISM

FIELD OF THE INVENTION

The present invention generally relates to an electrical connector, and more particularly to an electrical connector with an improved metallic shutter mechanism.

DESCRIPTION OF PRIOR ART

U.S. Pat. No. 7,661,990 issued on Feb. 16, 2010 discloses an electrical connector comprising an insulative housing, a number of terminals retained in the insulative housing, a shell covering the insulative housing and a shutter mechanism. The shell defines a mating port. The shutter mechanism is mounted to the shell and located at the mating port so as to prevent dust from entering the mating port and protect the terminals. However, the shutter mechanism has a complicated structure, furthermore does not provide a function of electrostatic discharge (ESD).

Hence, an improved electrical connector is highly desired to overcome the aforementioned problems.

SUMMARY OF THE INVENTION

The present invention provides an electrical connector including a metal shell, an insulative housing, a plurality of terminals retained in the insulative housing and a shutter. The metal shell defines a receiving space with a mating port. The insulative housing defines a mating portion extending forwardly and received in the receiving space. The mating portion defines two rows of passageways exposed on opposite surfaces thereof. The terminals include contact portions retained in the corresponding passageways of the mating portion. The shutter is located in the mating port of metal shell. The shutter is made of metal sheet and pivotally mounted to the shell. The shutter includes a main portion and a pair of shafts extending outwardly form two sides of one end of the main portion.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
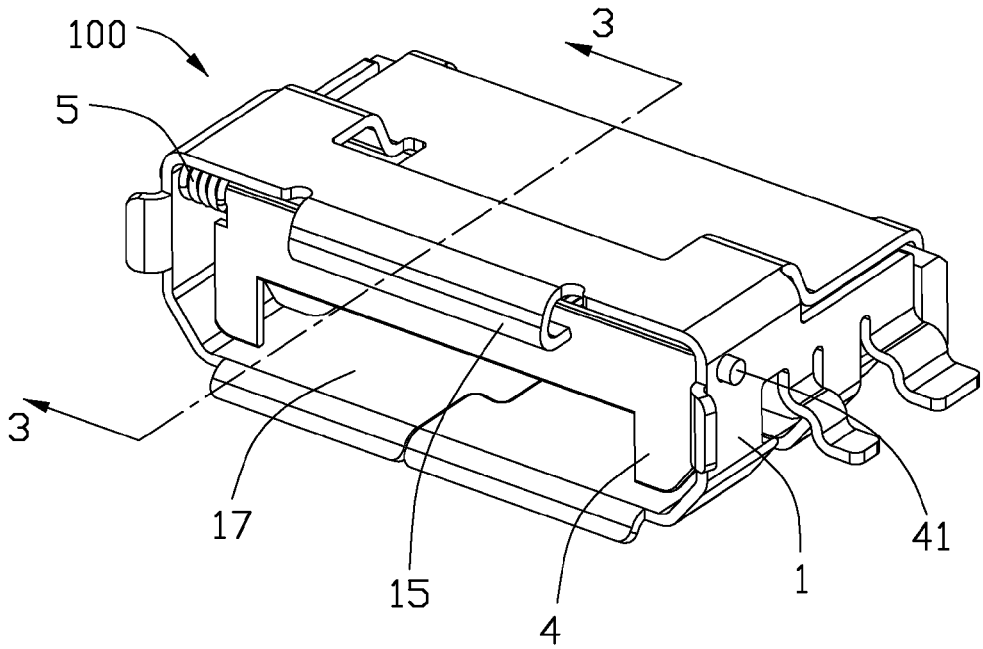
FIG. 1 is a perspective view of an electrical connector of an embodiment of the present invention.
Figure 2:
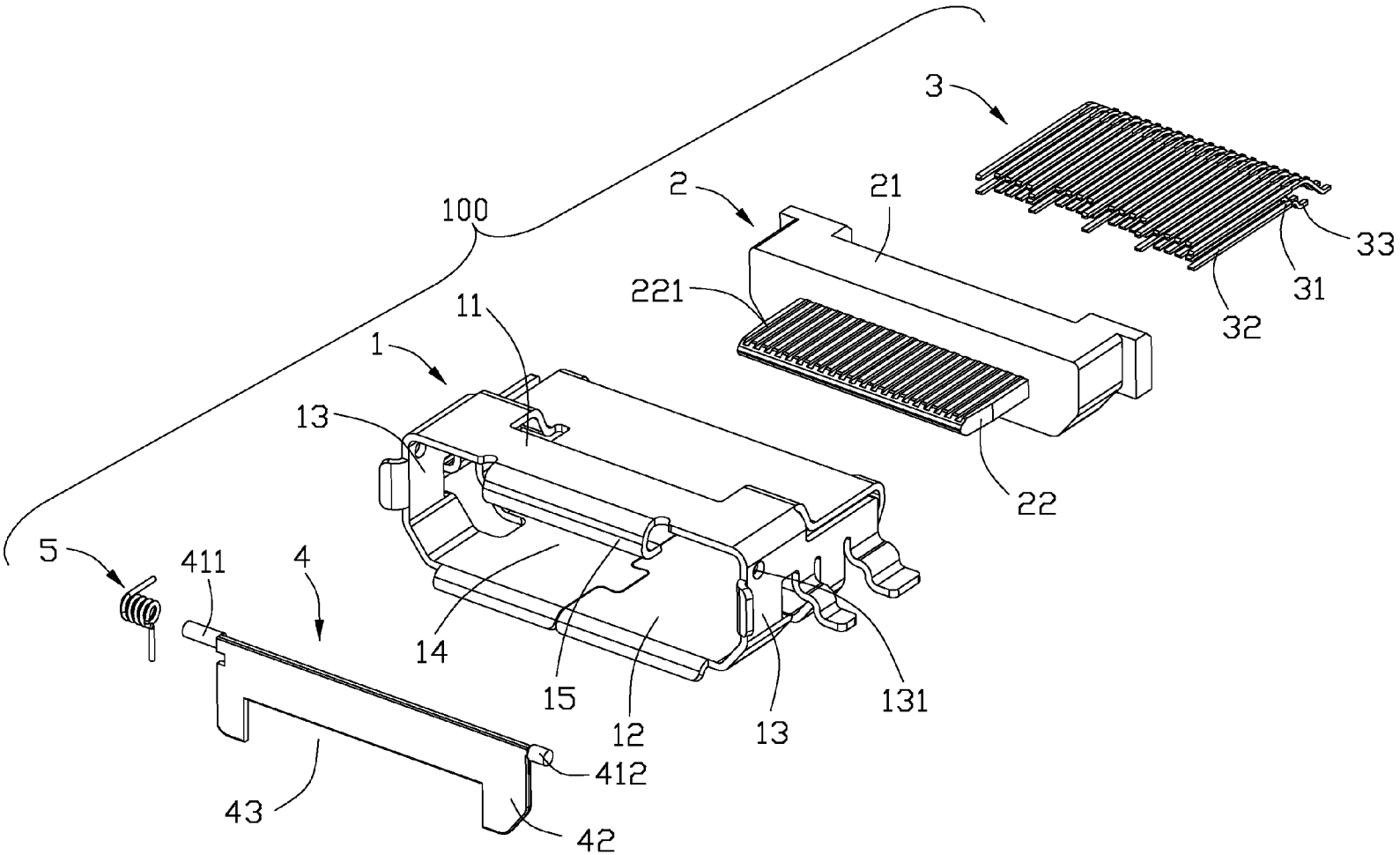
FIG. 2 is an exploded, perspective view of FIG. 1.

Referring to FIGS. 1 and 2, an electrical connector 100 comprises a metallic shell 1, an insulative housing 2 received in the metallic shell 1, a plurality of terminals 3 secured in the housing 2 and a metallic shutter 4.

The shell 1 comprises a top wall 11, a bottom wall 12 opposite to the top wall 11 and a pair of opposite side walls 13 respectively connecting the top wall 11 with the bottom wall 12. The top wall 11 comprises a front section 111 and a rear section 112 which unitarily extends from the front section 111. The rear section 112 is lower than the front section 111. The shell 1 defines a receiving space 14 commonly enclosed by the walls of the shell 1 with a mating port 17.

The insulative housing 2 comprises a base portion 21 and a mating portion 22 extending forwardly and received in the receiving space 14. Two rows of passageways 221 are respectively formed on opposite surfaces of the mating portion 22 and run through the base portion 21.

Each terminal 3 comprises a retention portion 31, a contact portion 32 extending forwardly from the retention portion 31 and a tail portion 33 extending rearwardly from the retention portion 31. The retention portions 31 are retained in the base portion 21 of the housing 2. The contact portions 32 are secured in the passageways 221 of the mating portion 22 and exposed to an exterior. The tail portions 33 extend beyond a rear face of the base portion 21 so as to be soldered to a printed circuit board (not shown).

Referring to FIGS. 2 to 5, the shutter 4 is made of metal sheet and pivotally mounted to the shell 1. The shutter 4 comprises a main portion 42 located at the mating portion 17 and a pair of pivot shafts 41 extending outwardly from two sides of an end of the main portion 42. One pivot shaft 411 is longer than the other pivot shaft 412. The two side walls 13 of the shell 1 define a pair of shaft holes 131 to engage with the corresponding shafts 41. A torsion spring 5 is wrapped around the longer pivot shaft 411 of the shutter 4. In assembly, firstly insert the longer pivot shaft 411 with the torsion spring 5 into the respective shaft hole 131. Secondly, suppress the torsion spring toward the adjacent side wall 13 so as to insert the other pivot shaft 412 into the other shaft hole 131. The torsion spring 5 has one end abutting against an inner side of the shutter 4 and an opposite end abutting against an inner side of the top wall 11 of the housing 1. The torsion spring 5, thereby, biases the shutter 4 to their closed portion shown in FIGS. 1 and 3. The shutter 4 not only prevents dust from entering into the receiving space 14, but also provides ESD protection. In the meantime, the shutter 4 has a simple structure and can be assembled easily. The shutter 4 has a notch 43 formed in the free end thereof. The notch 43 is aligned with the mating portion 22 of the housing 2.

The shell 1 further comprises a guide portion 15 bending rearward from a front edge of the top wall 11 and received in the receiving space 14. The guide portion 15 abuts against the shutter 4 to prevent the shutter 4 from rotating outwardly. The guide portion 15 is located coplanar with the rear section 112 of the shell 1. In the meantime, during mating with a mating connector (not shown), the mating connector is guided into the receiving space 14 by the guide portion 15.

Figure 3:
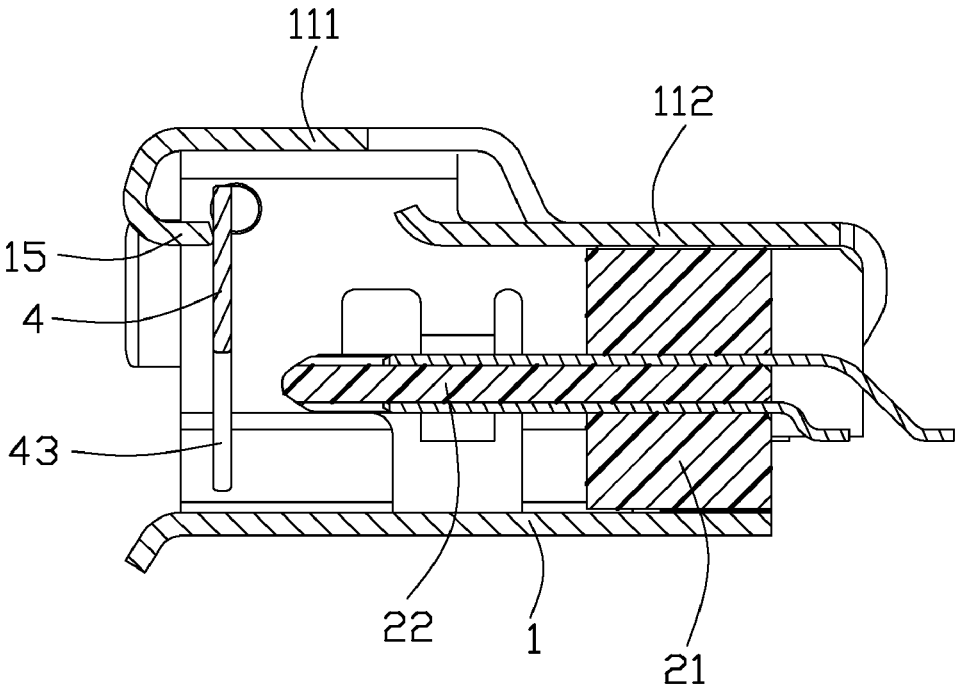
FIG. 3 is a cross-section view of the electrical connector taken along line 3-3 in FIG. 1, wherein the shutter is in a close position or an original statue.
Figure 4:
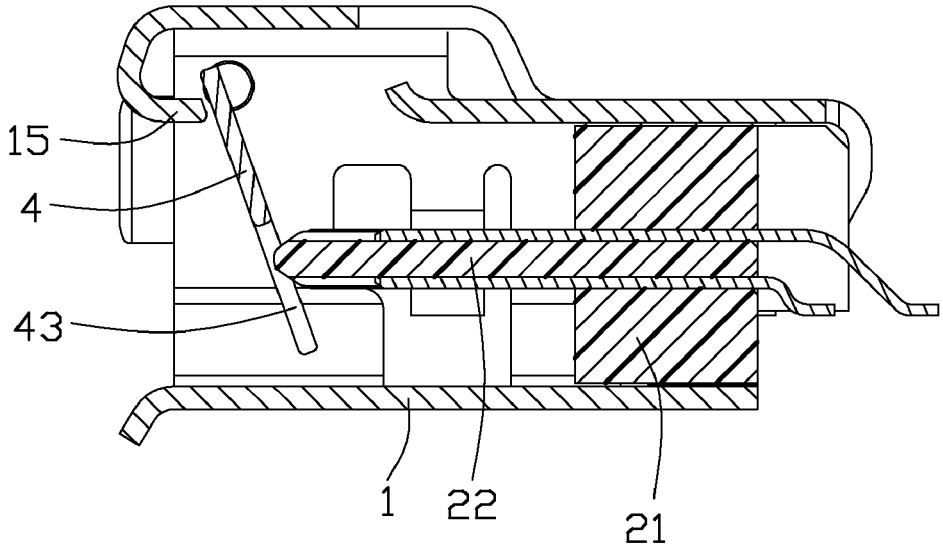
FIG. 4 is a cross-section view similar to FIG. 3 wherein, the shutter is rotated at a specified angle.
Figure 5:
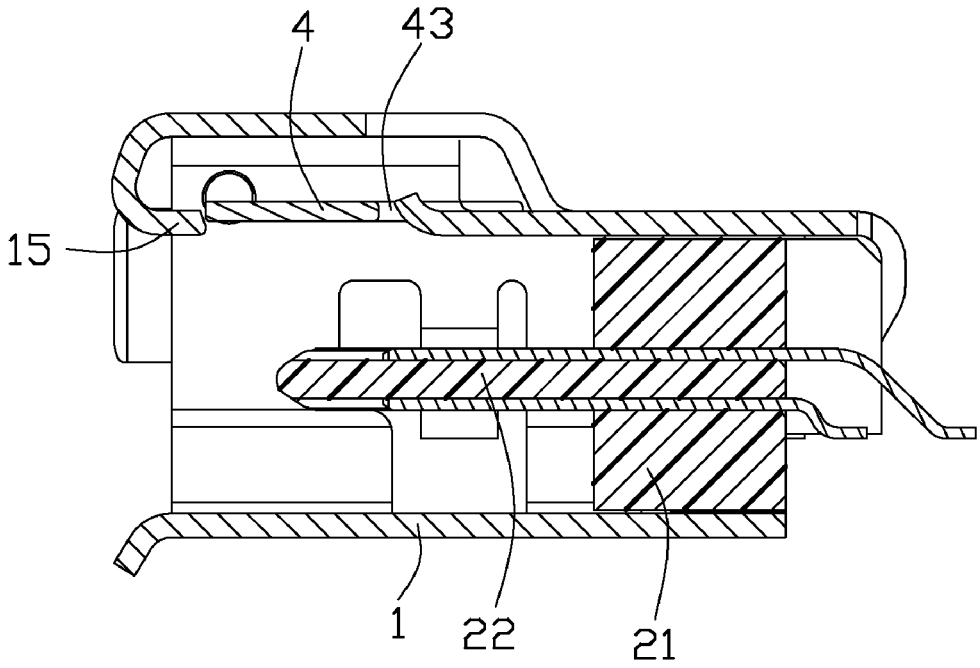
FIG. 5 is a cross-section view similar to FIG. 3 wherein the shutter is located at a full open position.

Referring to FIG. 3, before the mating connector mates with the electrical connector 100, the shutter 4 is in a closed position. Referring to FIG. 4, when the mating connector is partially inserted into the receiving space 14, the shutter 4 rotates at an angle. Referring to FIG. 5, the electrical connector engages with the mating connector, the shutter 4 is rotated to an opened position. The mating portion 22 passes through the notch 43 of the shutter 4 so as to not knock against the shutter 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a metal shell defining a receiving space with a mating port;

an insulative housing defining a mating portion extending forwardly and received in the receiving space, the mating portion defining two rows of passageways exposed on opposite surfaces thereof;

a plurality of terminals comprising contact portions retained in the corresponding passageways of the mating portion; and a shutter located in the mating port of metal shell; wherein the shutter is made of metal sheet and pivotally mounted to the shell, the shutter comprises a main portion and a pair of shafts extending outwardly form two sides of one end of the main portion;

wherein the metal shell comprises a top wall, a bottom wall opposite to the top wall and a pair of side walls connecting the top wall with the bottom wall, the side walls define a pair of shaft holes to engage with the shafts; wherein a torsion spring is wrapped around one pivot shaft of the shutter and comprises one end abutting against an inner side of the shutter and an opposite end abutting against an inner side of the top wall; wherein the shell further comprises a guide portion bending rearward from a front edge of the top wall thereof and received in the receiving space; wherein the guide portion abuts against the shutter to prevent the shutter from rotating outwardly; wherein the shutter has a notch formed in the free end thereof, the notch is aligned with the mating portion of the housing; wherein the top wall comprises a front section and a rear section which unitarily extends from the front section, and the rear section is lower than the front section.

2. An electrical connector, comprising:

a metal shell defining a receiving space with a mating port;

an insulative housing defining a mating portion extending forwardly and received in the receiving space;

a plurality of terminals comprising contact portions retained in the mating portion; and a shutter covering the mating port of metal shell; wherein the shutter is made of metal sheet and pivotally mounted to the shell, the shutter comprises a main portion and a pair of shafts extending outwardly form two sides of one end of the main portion; wherein the metal shell comprises a top wall, a bottom wall opposite to the top wall and a pair of side walls connecting the top wall with the bottom wall, the side walls define a pair of shaft holes to engage with the shafts; wherein a torsion spring is wrapped around one pivot shaft of the shutter and comprises one end abutting against an inner side of the shutter and an opposite end abutting against an inner side of the top wall.

3. An electrical connector comprising:

an insulative housing defining a base and a mating tongue extending forwardly therefrom;

a plurality of terminals disposed in the housing with contacting sections exposed upon at least one face of the mating tongue;

a metallic shell enclosing the housing and defining a mating port into which the mating tongue extends; and a shutter pivotally mounted to the shell about an axis; wherein the shutter defines a main portion rotated about said axis for inwardly entering the mating port and defining a contour essentially in compliance with an entrance opening of said mating port except a notch recessed from a far edge opposite to said axis for not interfering with mating tongue during rotation of the shutter; wherein the entrance opening defines a chamfered side and a straight side, and said axis is located on the straight side; wherein the main portion of the shutter defines a chamfered structure in compliance with the chamfered side of the entrance opening; wherein the shell forms a guide portion to prevent excessive outward movement of the shutter; wherein the notch is dimensioned essentially one half of the entrance opening in a vertical direction; wherein the shell defines a raised portion on a front region of a top wall to receive the shutter when said shutter is inwardly rotated to a horizontal position; wherein said raised portion defines a cutout configured similar to the notch; wherein said raised portion is linked to remaining portion of the top wall only on two sides beside said cutout; wherein a torsion spring is protectively located under the raised portion to abut against the shutter; wherein said shutter is metallic.

* * * * *